US006314653B1

(12) United States Patent
Iso

(10) Patent No.: US 6,314,653 B1
(45) Date of Patent: Nov. 13, 2001

(54) RULER DEVICE

(76) Inventor: Nobuaki Iso, 343-11 Quaza Sakata, Okegawa-shi, Saitama-ken (JP)

( * ) Notice: Subject to any disclaimer, the term of this patent is extended or adjusted under 35 U.S.C. 154(b) by 0 days.

(21) Appl. No.: 09/333,113

(22) Filed: Jun. 15, 1999

(30) Foreign Application Priority Data

Sep. 11, 1998 (JP) ..... 10-276560

(51) Int. Cl.[7] ..... B43L 7/00; B26D 7/02

(52) U.S. Cl. ..... 33/484; 33/485; 33/490; 83/465

(58) Field of Search ..... 83/465, 745; 33/484, 33/485, 489, 491, 493, 490, 492

(56) References Cited

U.S. PATENT DOCUMENTS 1,614,812 * 1/1927 Trane et al. ..... 33/485
2,522,908 * 9/1950 Szabo ..... 33/489
5,471,749 * 12/1995 Brady ..... 33/484

FOREIGN PATENT DOCUMENTS

3106176 * 9/1982 (DE) ..... 33/489

* cited by examiner

*Primary Examiner*—Randy W. Gibson
(74) *Attorney, Agent, or Firm*—Frishauf, Holtz, Goodman, Langer & Chick, P.C.

(57) ABSTRACT

A ruler device is disclosed. It comprises a ruler body, a spring member disposed on an upper surface of the ruler body such that the spring member is warped upwardly, and a slip-preventive member disposed on a lower surface of the ruler body, the slip-preventive member being caused to project downwardly when the spring member is depressed.

23 Claims, 15 Drawing Sheets

RULER DEVICE

BACKGROUND OF THE INVENTION

This invention relates to an improvement of a ruler device which can be used as a guide for drawing a line on a surface of an object, chiefly a sheet of paper, or for cutting the object. Particularly, it relates to a ruler device capable of preventing positional displacement in use and ensuring a smooth sliding movement when it moves from one place to another.

In general, a ruler device of the type mentioned above is molded of a variety of materials such as plastic, wood, bamboo, metal and the like. This ruler device is, in use, plane contacted with the surface of an object on which a line is required to be drawn. In drawing a line on the surface of the object with this ruler device, it is a usual practice that the ruler device is depressed by a finger tip of a single hand from the top and a writing instrument is held by the other hand. And in that condition, a forward end of the writing instrument is moved along the edge of the ruler device.

The ruler device is point-wise depressed by the finger tip because it is difficult for the finger tip to depress the entire surface of the ruler device. Therefore, the ruler device tends to turn about the depressed portion serving as a fulcrum by force, serving as an acting point, applied to the writing instrument at a location away from the fulcrum. In order to avoid this unfavorable turn of the ruler device, the user must increase the force for depressing the ruler device. Naturally, the user gets tired.

A ruler device with a handle is also known. In practice, however, this handle is bothersome. In addition, the ruler device with a handle is difficult to be not only stored but also to be carried.

A ruler device with a slip-preventive material such as a rubber sheet attached to the back is also known. This ruler device is, in fact, good for avoiding unfavorable displacement in use but a great inconvenience is encountered when this device is to be moved from one place to another because the rubber sheet prevents a smooth movement.

Another problem involved in the conventional ruler device occurs when an object is cut with use of the ruler device. Specifically, when an object is cut, a cutter is moved along the edge of the ruler device as mentioned above. At that time, the edge of the ruler device is occasionally cut by the cutter with a result that the ruler device itself becomes unusable.

The present invention has been accomplished in view of the above-mentioned actual status and problems inherent in the prior art devices.

SUMMARY OF THE INVENTION

It is, therefore, an object of the present invention to provide a ruler device which is reliably positioned in use without a fear of unfavorable positional displacement.

Another object of the invention is to provide a ruler device which can be smoothly moved, when required, from one place to another.

A further object of the invention is to provide a ruler device in which both a reliable positioning operation and a smooth moving operation can be performed merely by depressing and releasing one point of the device, namely, by a single touch action.

A still further object of the invention is to provide a ruler device which is removably attached with an optional item for cutting.

To achieve the above objects, there is essentially provided a ruler device comprising a ruler body, a spring member disposed on an upper surface of the ruler body such that the spring member is warped upwardly, and a slip-preventive member disposed on a lower surface of the ruler body, the slip-preventive member being caused to project downwardly when the spring member is depressed.

The spring member may be in the form of a plate or in the form of a rod.

The slip-preventive member may be a replaceable rubber piece, or a balloon which is inflated when the spring member is depressed.

The ruler device may include a cutter guide removably attached to at least one side of the ruler body. The spring member may be branched. The spring member may be connected to a wire, or it may be connected to a link and a cam mechanism.

The ruler body may be provided on the upper surface with a support portion for supporting an end portion of the spring member. The ruler device may include a reinforcement ridge integrally formed with the support portion in a frame-like pattern such that the spring member can go in and out. The spring member may be provided at a central area thereof with a point mark for depressing. The spring member may be composed of a plurality of plates or rods continuously connected together. The ruler device may include a stopper for preventing the spring member from moving beyond a dead point.

By virtue of the above-mentioned construction, the ruler device is, when in use, placed on the surface of an objective sheet of paper or the like, and then the spring member is depressed by a finger tip of one hand to project the slip-preventive member. By doing so, the ruler device is reliably positioned on the surface of an objective sheet of paper or the like and never displaced even when force is applied to the edge portion of the ruler device by a writing instrument. Then, by releasing the depressing force, the slip-preventive member is returned to its initial state and therefore, the ruler device can move from one place to another smoothly. The above operations can be performed by a single touch action.

Various advantages and features which characterize the present invention are pointed out with particularity in the claims annexed hereto. However, for a better understanding of the present invention, its advantages, and objects attained by its use, reference should be made to the drawings, and to the accompanying description, in which there is illustrated and described some preferred embodiments of the present invention.

BRIEF DESCRIPTION OF THE INVENTION

DETAILED DESCRIPTION OF THE EMBODIMENTS

Figure 1:
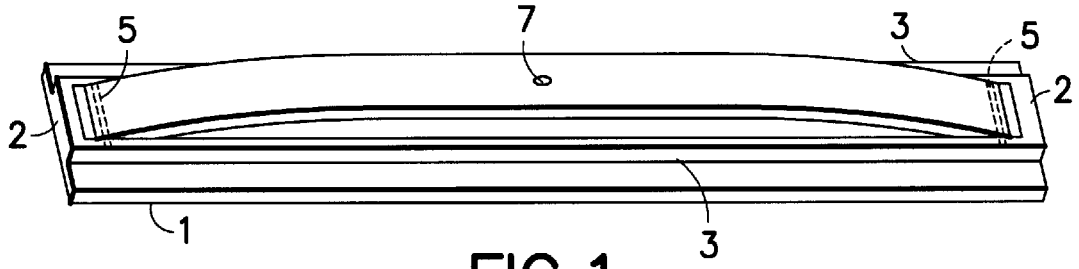
FIG. 1 is an overall perspective view of a ruler device according to one embodiment of the present invention.
Figure 2:
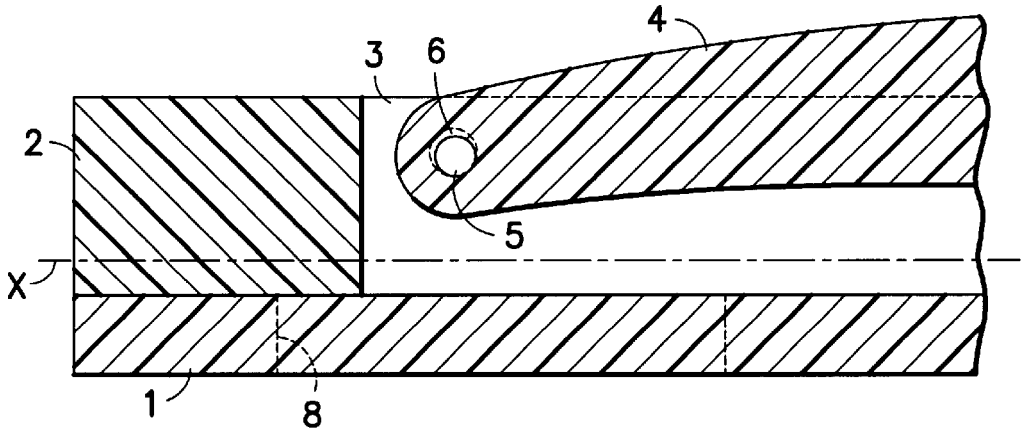
FIG. 2 is a sectional view schematically showing an end portion of the ruler device of FIG. 1.

A ruler device embodying the present invention will now be described with reference to the accompanying drawings.

Reference numeral 1 denotes a ruler body. In this embodiment, the ruler body 1 is molded of plastic. Support members 2 for supporting end portions of a spring member which will be described later and reinforcement ridges 3 are integrally formed, in a frame-like pattern, on the surface of the ruler body 1.

Reference numeral 4 denotes a plate-like spring member which is warped just like a bow with its central portion expanded upwardly. In this embodiment, this plate-like spring member 4 is also molded of plastic such that its end portions are thin and its central portion are thick. The width of the plate-like spring member 4 is such dimensioned that it generally matches with an interval between the reinforcement ridges 3.

In this embodiment, the plate-like spring member 4 is supported at opposite end portions thereof by pins 5. At the end portions, the pins 5 extend all the way through the width of the plate-like spring member 4 with opposite ends of the pins 5 projected outwardly.

On the other hand, each reinforcement ridge 3 is formed in an inner surface thereof with an engagement hole 6 for one end portion of each pin 5 engaged therein. The engagement holes 6 are larger in diameter than the pins 5 and preferably have a vertically oblong configuration. The engagement holes 6 are located upwardly of a center line X of resilient force when the ruler body 1 and the plate-like spring member 4 are in superposed relation.

A point mark 7 is marked on a central area of the plate-like spring member 4. This point mark 7 serves as a mark for recognizing a depressing place.

A rectangular window 8 is formed in area in the vicinity of each end of the ruler body 1 beneath part of a lower surface of each support portion 2. A movable plate 9 is resiliently held at four places thereof by coiled springs 10 such that the movable plate 9 is located astride each window 8. The movable plate 9 has a projection 9a to be engaged in the window 8.

Five attachment holes 9*b* are formed in a lower surface of the projection 9*a,* one at the center and the remaining four at the four corners. A slip-preventive rubber piece 11 having engagement pins 11*a,* which project from an upper surface thereof, is attached to the movable plate 9 with the engagement pins 11*a* snapped in the corresponding attachment holes 9*b.* Owing to this arrangement, the rubber piece 11 can easily be replaced with new one when it is worn. Reference numeral 9*c* denotes a cut-out for receiving a tip of a tool such as a minus driver used for removing the rubber piece 11. In the initial state, the lower surfaces of the opposite ends of the plate-like spring member 4 are in abutment with an upper surface of the movable plate 9 and the rubber piece 11 is located in the windows 8.

Figure 3:
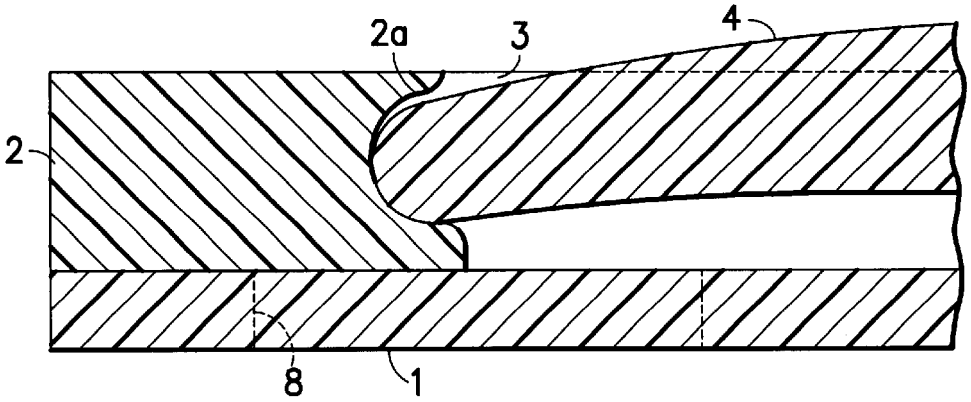
FIG. 3 is a sectional view of another example schematically showing an end portion of the ruler device of FIG. 1.
Figure 4:
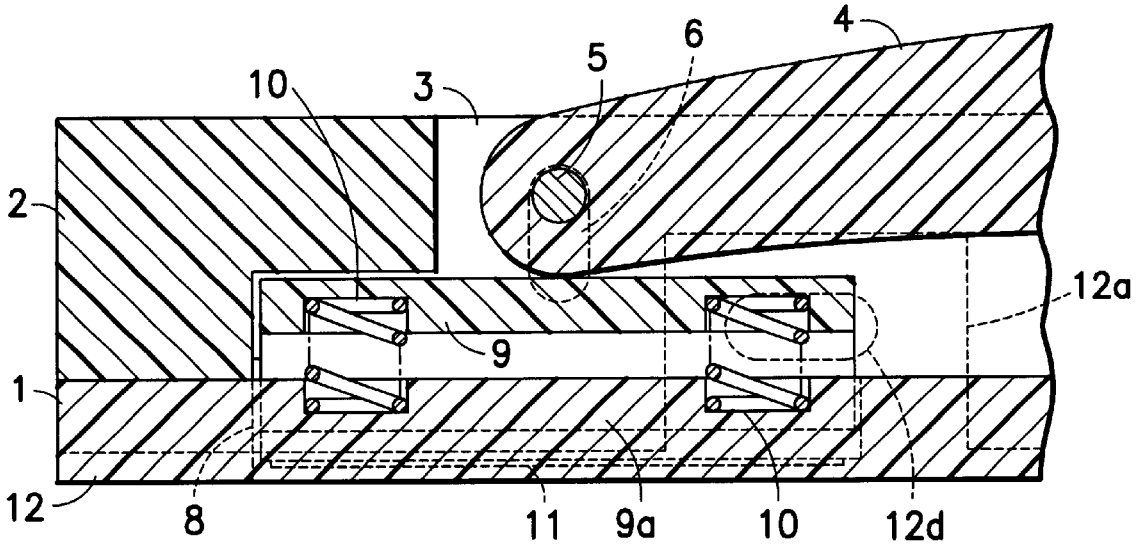
FIG. 4 is a sectional view of the end portion of FIG. 2 with a mechanism assembled therein.
Figure 5:
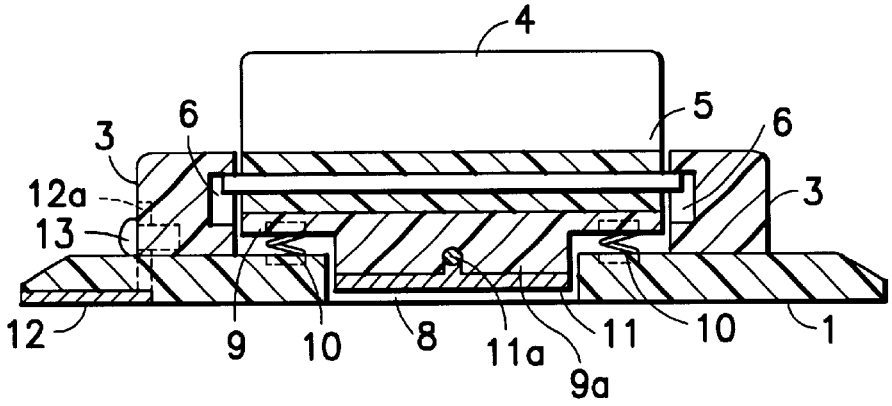
FIG. 5 is a sectional view of the end portion, when viewed in a different direction, of FIG. 4.
Figure 6:
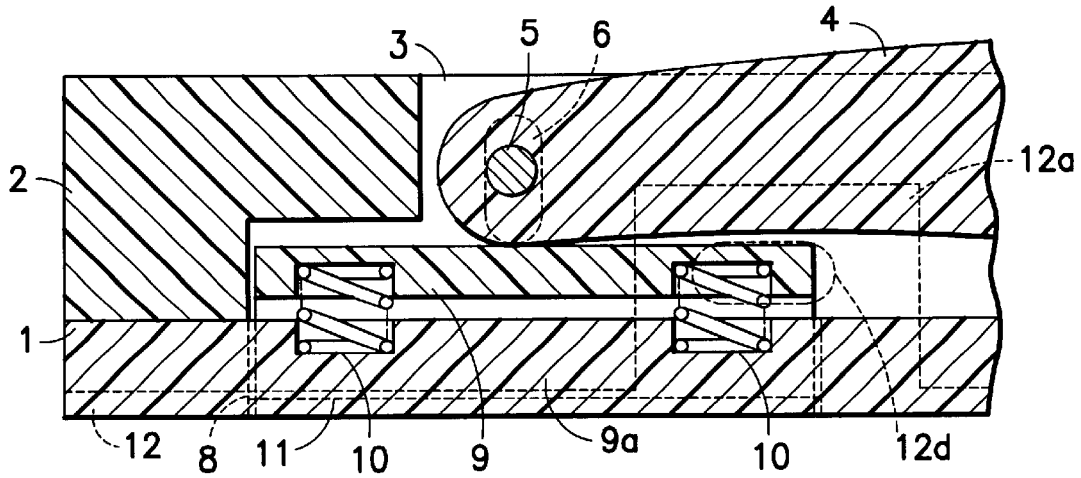
FIG. 6 is a sectional view of the end portion, when in use, of FIG. 4.
Figure 7:
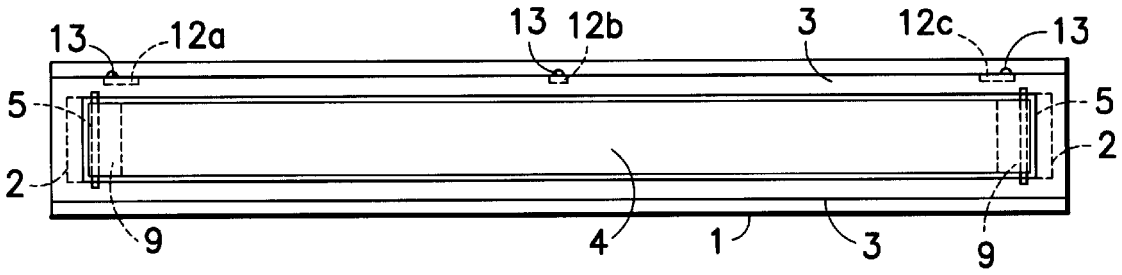
FIG. 7 is an overall plan view of the ruler device of FIG. 1.
Figure 8:
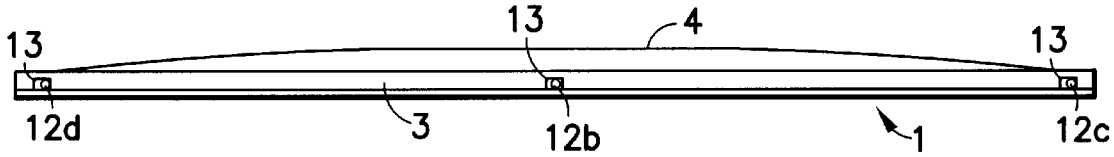
FIG. 8 is a side view thereof.

As shown, for example, in FIG. 3, the plate-like spring member 4 may be attached to the ruler body 1 by snag-fitting a round surface of its end portion to an arcuate recess 2*a* formed in an inner surface of the support portion 2. It is also an interesting alternative that an inner surface of the support portion 2 is tapered so that the end portion of the plate-like spring member 4 will come off, then a rubber piece is directly attached to a recessed area of the window 8 which recessed area is lower than a bottom surface of the ruler body 1, and the rubber pieces are directly pushed by the lower surfaces of the opposite ends of the plate-like spring member 4 so that the rubber pieces will project.

Reference 12 denotes a cutter guide. This cutter guide 12 is set to a groove-like mounting portion which is formed in a lower surface of a longitudinal edge of the ruler body 1. Attachment flanges 12*a,* 12*b,* 12*c* are integrally formed on an upper surface of the cutter guide 12 in their erected postures. A laterally elongate attachment hole 12*d* is formed in each of the attachment flanges 12*a,* 12*c* and a normal attachment hole is formed in the attachment flange 12*b* which is located between the attachment flange 12*a* and the attachment flange 12*c*. The attachment flange 12*b* is fixed by a screw 13 in a normal manner. The remaining attachment flanges 12*a,* 12*c* are fixed by the screws 13 with a space S such that the screws 13 are somewhat in their floating states.

The so far described is a basic construction of the present invention. Operation of the invented ruler device will now be described. First, the ruler body 1 is placed on the surface of an objective sheet of paper or the like and the central portion, as marked with the point mark 7, of the plate-like spring member 4 is depressed. In doing so, resilient force itself of the plate-like spring member 4 is transmitted to the opposite ends to move the pins 5 downwardly along the engagement holes 6. In accordance with the downward movement of the pins 5, the opposite end portions of the plate-like spring member 4 pushes a top surface of the movable plate 9. Then, the coiled springs 10 are depressed to move the projection 9*a* of the movable plate 9 downwardly through the interior of the window 8, so that the rubber pieces 11 projects inwardly of the window 8.

Figure 9:
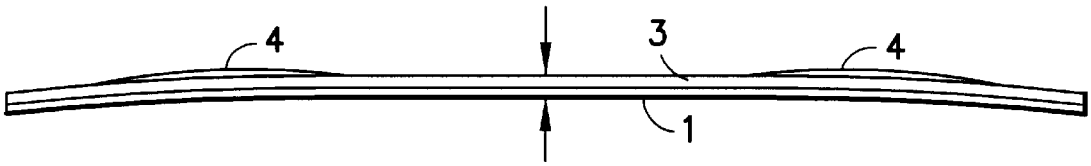
FIG. 9 is a side view, when deformed under pressure, of FIG. 8.
Figure 10:
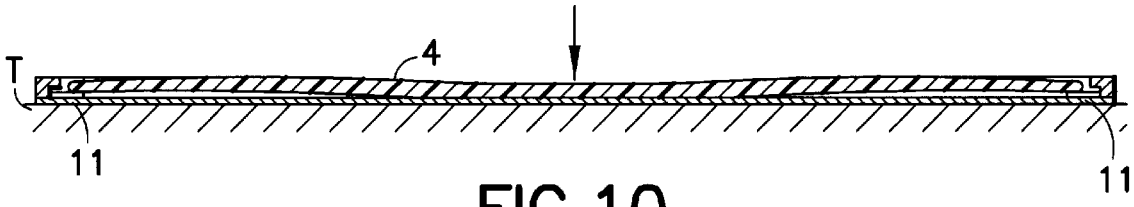
FIG. 10 is a sectional view, when used on a desk, of FIG. 8.
Figure 11:
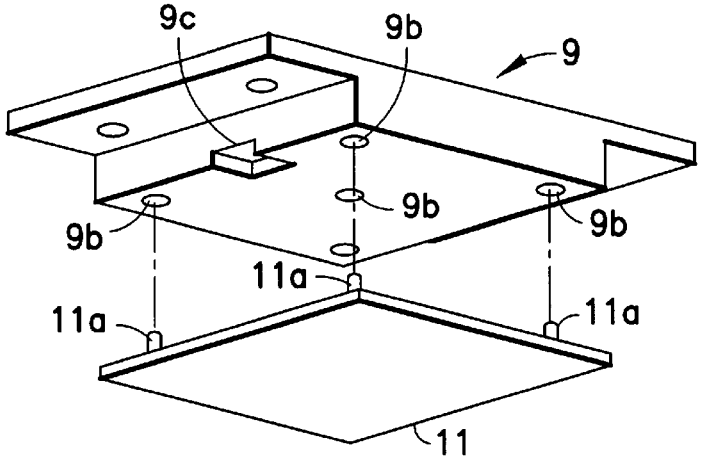
FIG. 11 is an exploded perspective view showing an attachment structure of a rubber piece of FIG. 10.

The projected rubber pieces 11 make it possible to position the ruler body 1, first at its each end. When the plate-like spring member 4 is further depressed until it is brought into abutment with the ruler body 1, force occurs to move the pins 5 outwardly of the end portions of the plate-like spring member 4 because the pins 5 are located above the center line X of resilient force when the ruler body 1 and the reinforcement ridge 3 and plate-like spring member 4 are superimposed. As a result, the opposite ends of the ruler body 1 are deformed in such a manner as to be turned upwardly. As a result, the center lower surface of the ruler body 1 is firmly pressure contacted with the surface of the objective sheet of paper or the like (see FIGS. 9 and 10 where T denotes a table).

For working, the plate-like spring member 4 is nested between the reinforcement ridges 3 thereby making it possible to draw a line or the like in a stable manner. When the position of the ruler body 1 is to be moved, the force applied to the plate-like spring member 4 is released so that the mechanism will return to its initial state. Thus, the ruler body 1 can move from one place to another smoothly.

Since the attachment flanges 12*a,* 12*c* are formed with laterally elongate attachment holes 12*d* and fixed by the screws 13 with the space S such that the screws 13 are somewhat in their floating states, the guide cutter 12 can easily attach to the ruler body 1 irrespective of deformation of the ruler body 1.

Figure 12:
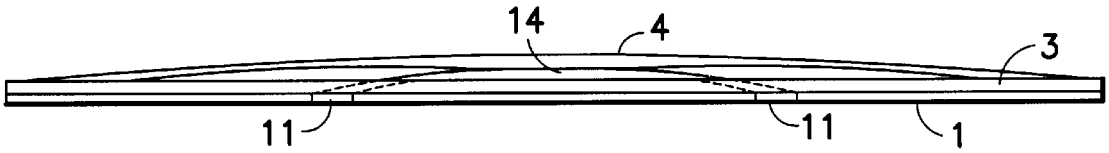
FIG. 12 is a side view showing another example of the rubber piece assembled in the ruler device.
Figure 13:
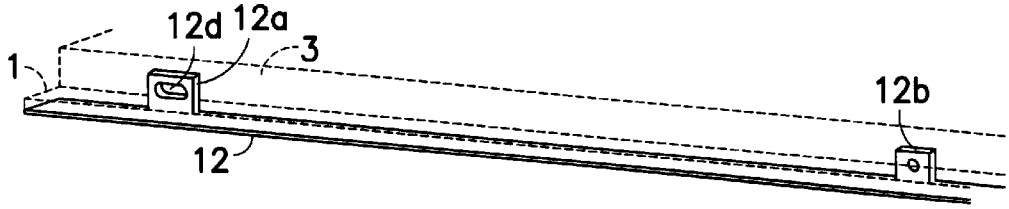
FIG. 13 is a partial perspective view showing an attachment mechanism of a cutter guide.

In the case where the ruler body 1 is long, as shown in FIG. 12, a frame engageable with a rather short plate-like spring member 14 may be disposed in superposed relation with the plate-like spring member 4. Furthermore, the aforementioned movable plate 9 mechanism may be disposed at the lower surface center of the ruler body 1.

Figure 14:
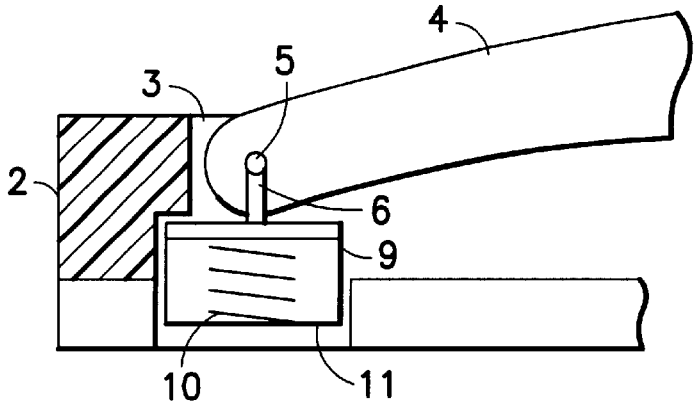
FIG. 14 is a schematic view showing another example of the end portion of the ruler device.

The above-mentioned basic construction may be additionally modified as follows. In an example of FIG. 14, the coiled spring 10 in the movable plate 9 is of a single structure.

Figure 15:
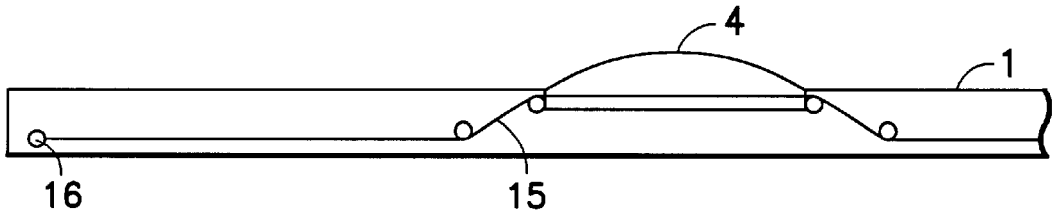
FIG. 15 is a schematic view showing another embodiment of a ruler device with a wire employed according to the present invention.

In an example of FIG. 15, a rather short plate-like spring member 4 is disposed at a central area of the ruler body 1 such that a wire 15 is actuated to cause the rubber pieces to be projected in accordance with depressing deformation of the plate-like spring member 4. In this example, not only the end portion but also the rubber pieces connected thereto can be projected towards the lower surface of the ruler body 1. Since the wire 15 is disposed over the roller 16 and retains tension, depression of the plate-like spring member 4 causes the wire 15 to pull or push the support portions 16 at the opposite ends so that the rubber pieces 11 will project by that force.

Figure 16:
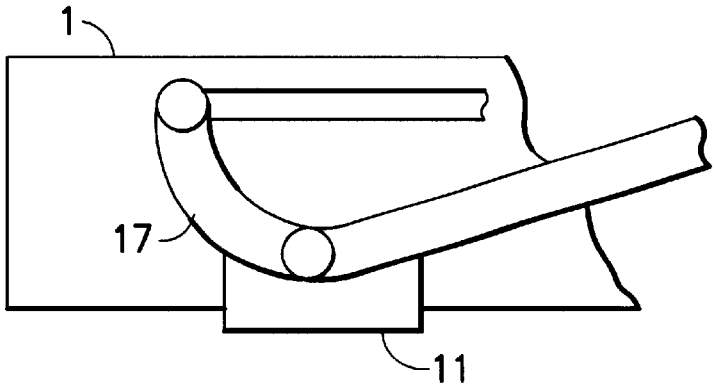
FIG. 16 is a schematic view of the end portion thereof.

As shown in FIG. 16, an arcuate link bar 17 may be employed. In this example, the link bar 17 is actuated so that the rubber piece 11 will go in and out.

Figure 17:
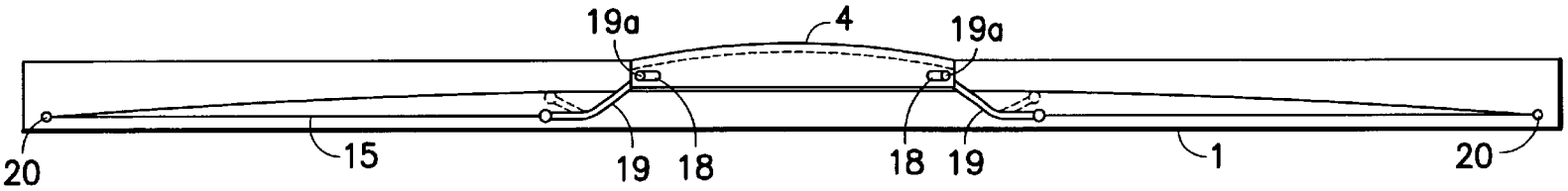
FIG. 17 is a schematic view showing a further embodiment of a ruler device with a wire employed according to the present invention.
Figure 18:
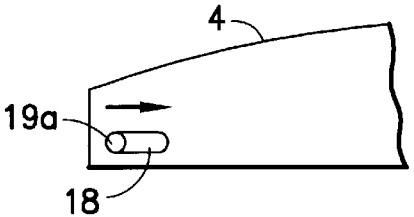
FIG. 18 is a view showing a state of engagement.

In an example of FIG. 17, there is also employed a wire 15. In this example, a reinforcement portion is formed longitudinally over the entire upper surface of the ruler body 1 and a window is formed in a central portion of the reinforcement portion. A spring member 4 is fitted into this window as a control portion. Two lateral grooves 18, 18 are formed in opposite sides of a lower edge of the spring member 4. Engagement pins 19*a* provided at one ends of working bars 19 are engaged in the corresponding lateral grooves 18, 18.

Distal ends of the working bars 19 are bent at obtuse angles and one end of the wire 15 is connected to each of the distal ends. The wire 15 is connected through the support portions 20 located on the opposite ends of the ruler body 1. Depression of the spring member 4 causes the engagement pins 19 to slide through the lateral grooves 18 towards each other but the distal ends of the working bars 19 are pivoted about the engagement pins 19*a* and raised to tension the support portions 20. This tensile force causes the rubber pieces to project.

Figure 19:
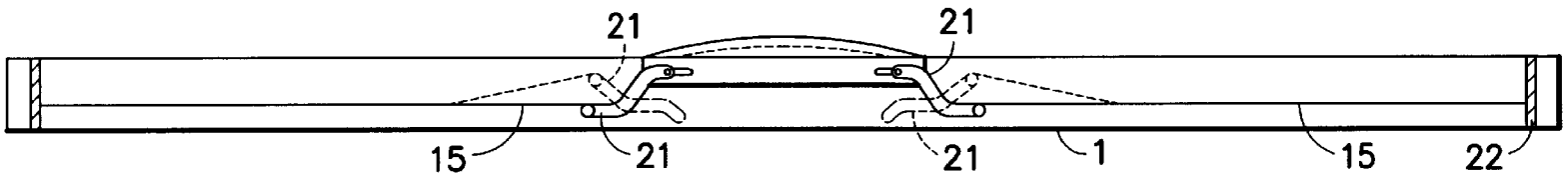
FIG. 19 is a schematic view showing a still further embodiment of a ruler device with a wire employed according to the present invention.

FIG. 19 shows a modification of FIG. 17. In this modified example, generally S-shaped link bars 21 are pivotally supported at their one ends by opposite ends of a lower edge of the spring member 4 and the other ends of the link bars 21 are connected to support portions 22. Owing to the this arrangement, when the spring member 4 is depressed, the link bars 21 are pivoted about the pivots to thereby lift the wires 15 so that the support portions 22 are tensioned. This tensile force causes the rubber pieces to project.

Figure 20:
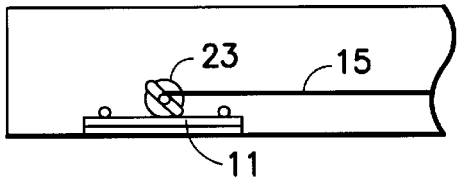
FIG. 20 is a schematic view of an end portion thereof prior to use.
Figure 21:
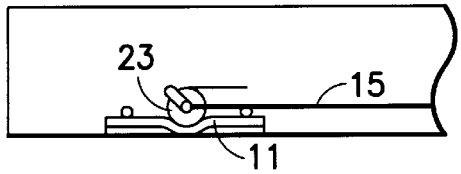
FIG. 21 is a schematic view of FIG. 20, now in use.

Projection of the rubber piece 11 using the wire 15 can be achieved by rotating a roller 23 in abutment with the rubber piece 11 as shown, for example, in FIGS. 20 and 21. By providing the roller 23 in an eccentric state, the rubber piece 11 can be projected more effectively.

Figure 22A:
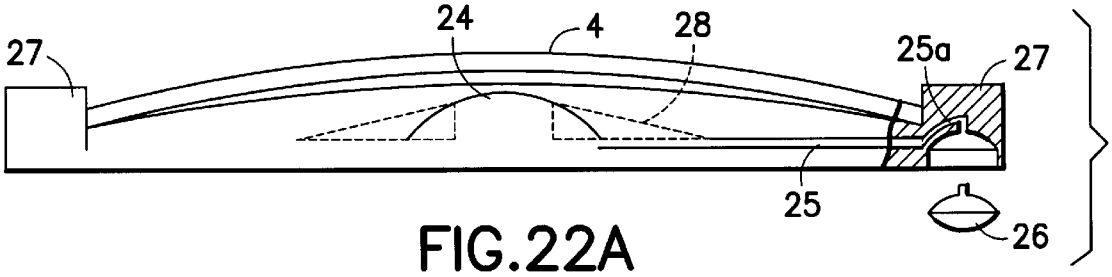
FIG. 22 is a schematic view showing a yet further embodiment of a ruler device with a balloon employed according to the present invention.
Figure 22B:
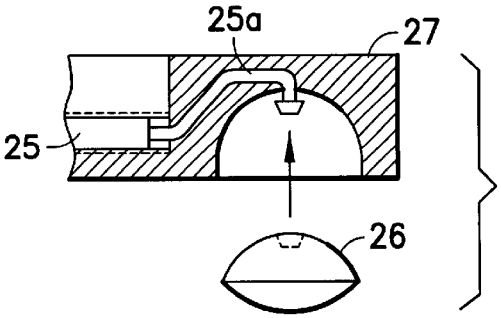
Figure 22C:
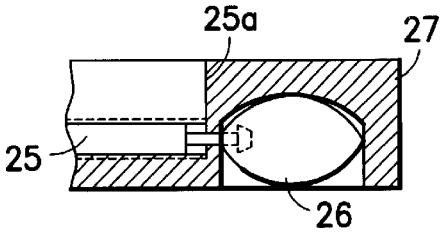
Figure 23:
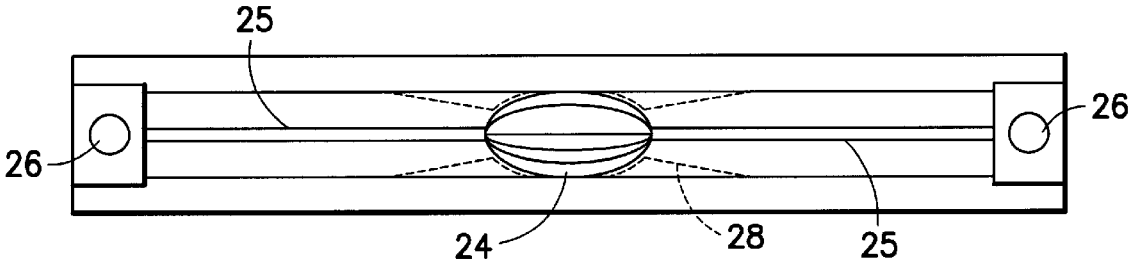
FIG. 23 is a plan view thereof.

A balloon made of rubber may be used as the slip-preventive member. In that case, a ridge 4*a* for depressing operation is integrally formed on the lower surface of the plate-like spring member 4 and abutted with a part of a compression ball 24. Tubes 25 are connected to opposite ends of the compression ball 24. Balloons 26 having a thick bottom are connected, either directly or through a joint 25*a,* to distal ends of the tubes 25 in a vertical or lateral direction. The balloons 26 are received in boxes 27 so that they will not expand laterally. The compression ball 24 is dimensioned comparatively large in case it is designed for feeding air or other gasses, and comparatively small in case it is designed for feeding liquid such as water. Reference numeral 28 of FIGS. 22 and 23 denotes a partition for restricting escape of the compression ball 24.

Figure 24:
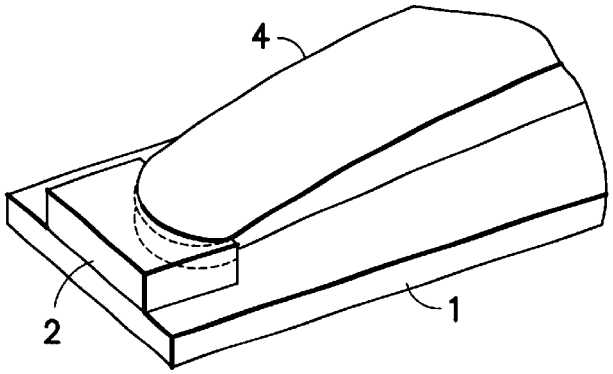
FIG. 24 is a perspective view showing an essential portion of one example of a support structure of a spring member.
Figure 26:
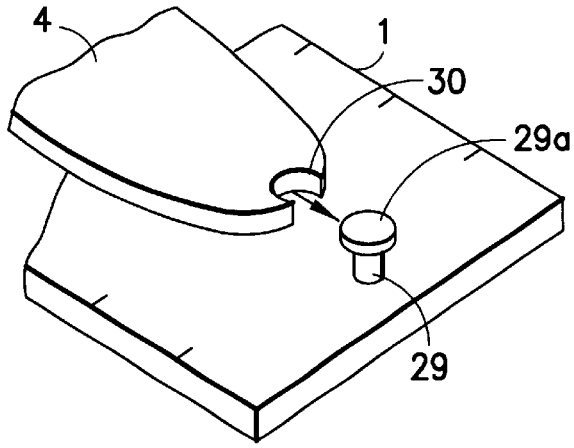
FIG. 26 is a schematic view showing an essential portion of one example of a support structure of a spring member.
Figure 27:
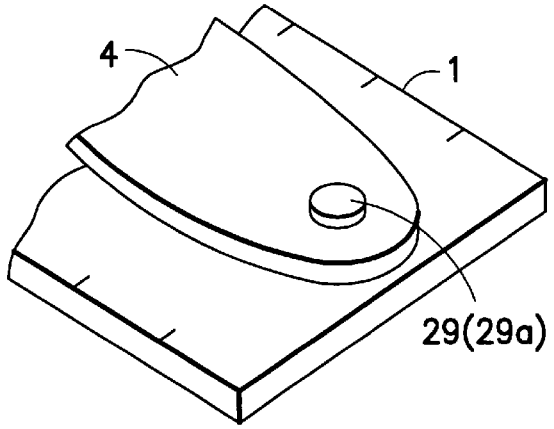
FIG. 27 is a perspective view of the essential portion.
Figure 28:
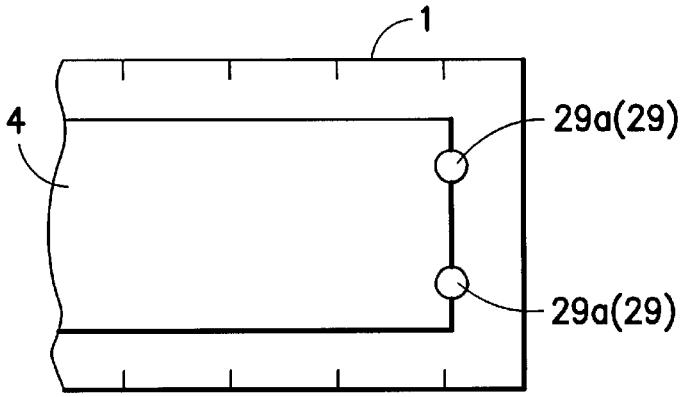
FIG. 28 is a plan view of the essential portion.

For connection between the plate-like spring member 4 and the support portion 2, as shown in FIG. 24, it is accepted that the end portion of the spring member 4 is rounded and a receiving portion matching with the rounded end portion is formed on the support portion 2. It is also an interesting alternative that, as shown in FIG. 26, a pin pole 29 having a restricting portion on its head portion is disposed, in its erected posture, as the support portion and an engagement gut-out portion 30 formed at a distal end of the spring member 4 is brought into engagement with the pin pole 29.

For achieving connection with the spring member 4, an indent may be formed at the end portion of the spring member 4 so that connection can be achieved by the pin pole 29 through the indent. In the case where an engagement construction is employed, the end portion of the spring member 4 may be formed into a linear configuration and engaged with the pin poles 29.

Figure 25:
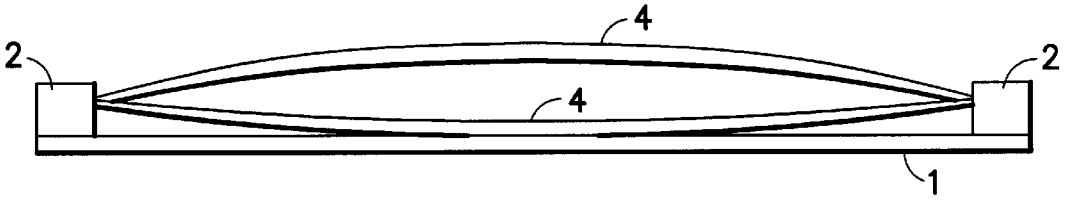
FIG. 25 is a side view of one example in which two plate-like spring members are in superposed relation.

In the case where the end portions of the spring member 4 are fixed as mentioned above, if the thickness of the spring member 4 is larger than the ruler body 1, resilient force of the spring member 4 is larger than the ruler body 1 and thus the intended purpose can be achieved satisfactorily. For this purpose, two spring members warped in opposite directions as shown in FIG. 25 may be used in combination.

Figure 29:
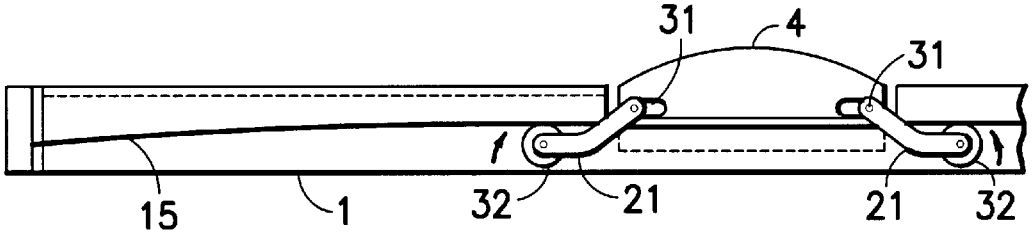
FIG. 29 is a schematic view showing another embodiment of a ruler device with a wire and a link are employed according to the present invention.
Figure 30:
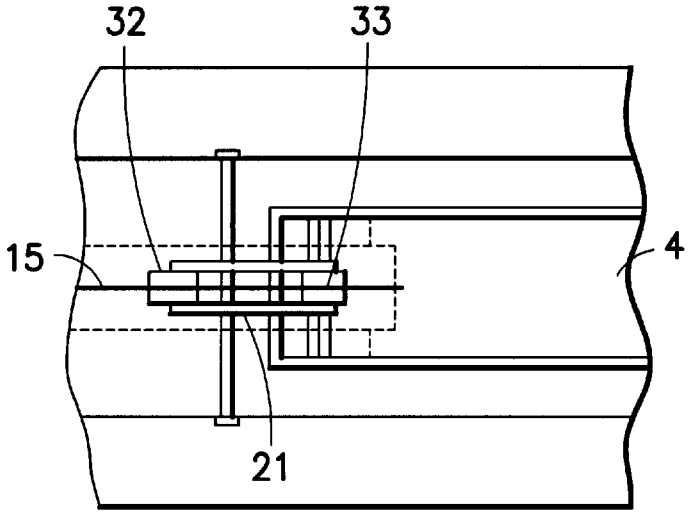
FIG. 30 is a plan view of an essential portion of the above.
Figure 31:
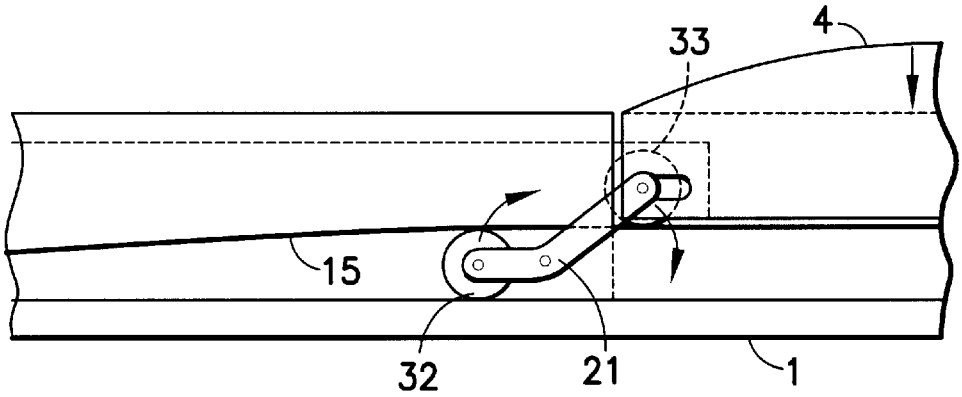
FIG. 31 is a side view of the essential portion.

As a modification of the above example using the link bars 21, FIGS. 29 to 31 show another example. In this modified example, laterally elongate holes 31 are formed in the opposite ends of the lower edge of the spring member 4 (control element) in order to support one ends of the link bars 21. Tension rollers 32 are attached to the other ends of the link bars 21. The tension rollers 32 are in abutment with the wire 15. Thus, depression of the spring member 4 causes the link bars 21 to be pivoted and the wire 15 is lifted by the tension rollers 32. Each link bar 21 is of a dual structure so that the tension roller 32 and the guide roller 33 are held therebetween. In accordance with rotation of the link bars 21, the guide rollers 33 depress the wire 15 downwardly.

Figure 32:
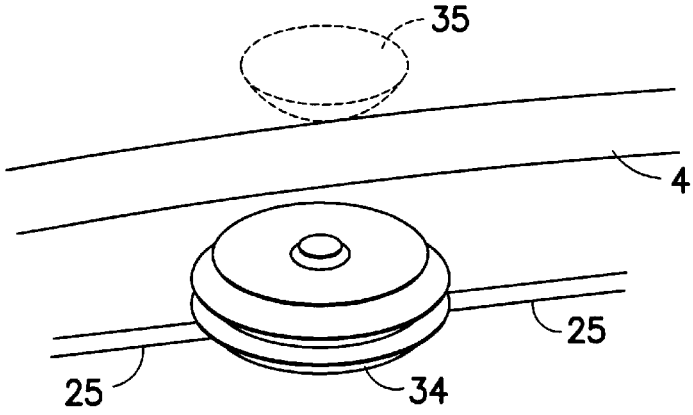
FIG. 32 is a partial perspective view showing a compressor mechanism for feeding air.
Figure 33:
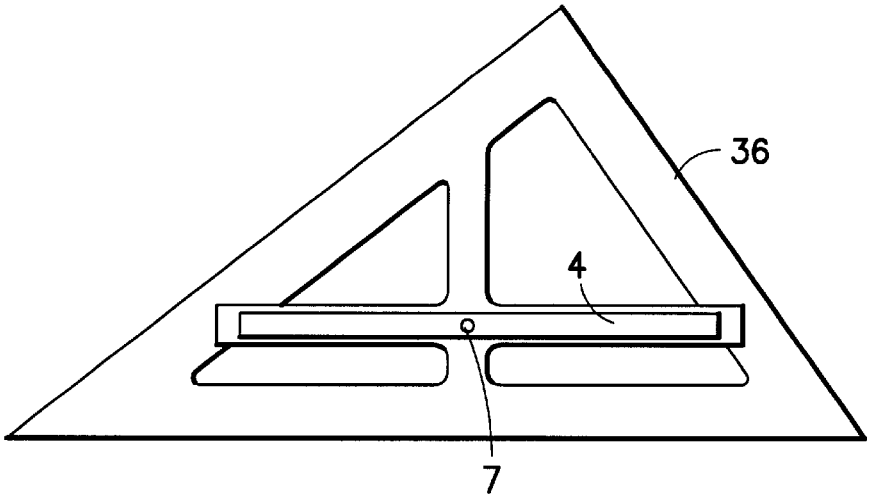
FIG. 33 is a plan view showing one example in which the present invention is applied to a triangular ruler device.
Figure 34:
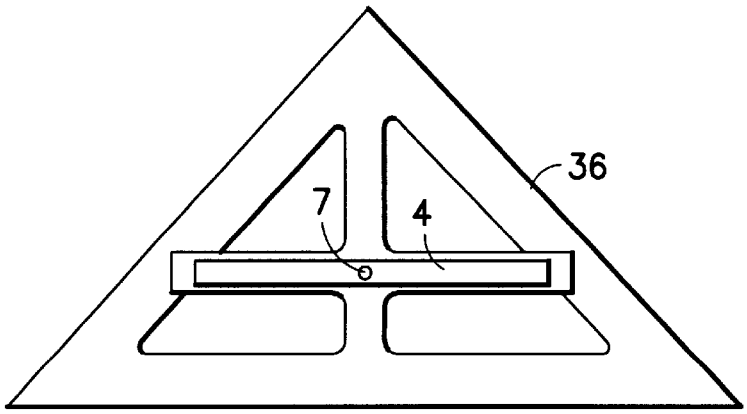
FIG. 34 is a plan view showing another example of the above.
Figure 35:
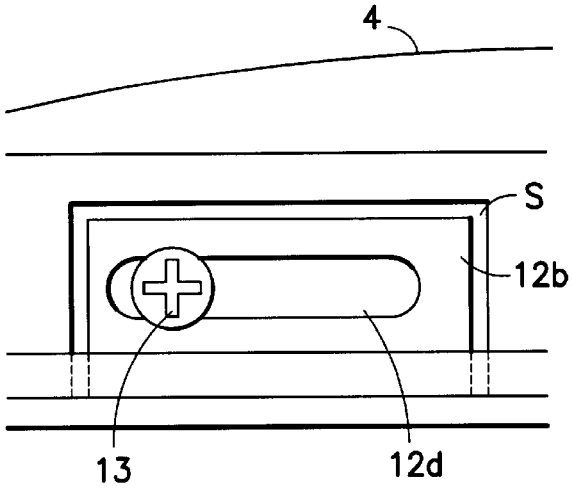
FIG. 35 is an enlarged view of an attachment portion of a cutter guide.

FIG. 32 shows a modification of the above example using the balloons. In this modified example, a compressor 34 is used instead of the compression ball 24. A pressing botch-like member 35 having a semispherical configuration in match with a top surface of the compressor 34 is formed on the lower surface of the spring member 4.

Figure 36:
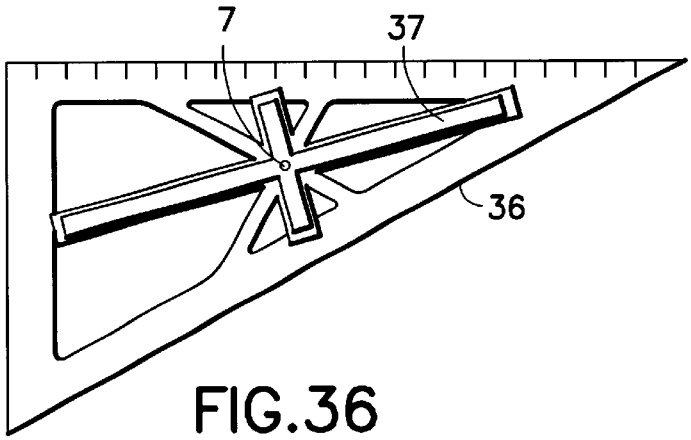
FIG. 36 is a perspective view in which the present invention is applied to a triangular ruler device.
Figure 37:
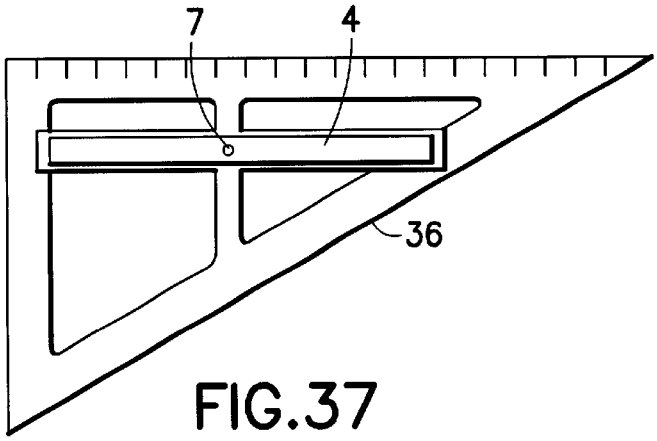
FIG. 37 is a plan view showing another example of the above.
Figure 38:
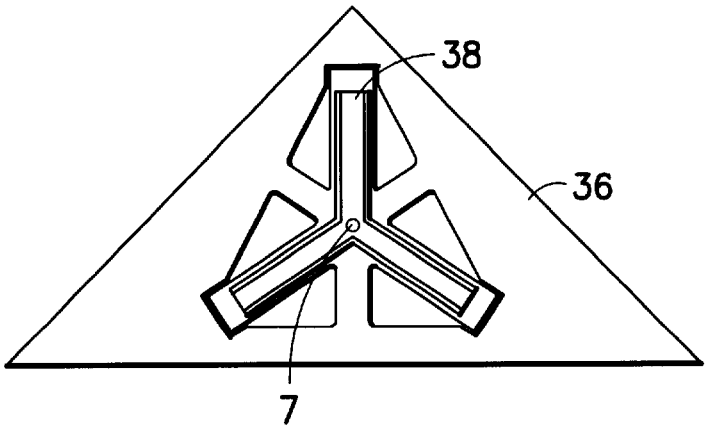
FIG. 38 is a plan view showing still another example of the above.

FIGS. 33 to 38 show several examples in which the present invention is applied to a triangular ruler device. Depending on which side of the triangular ruler device 36 is to be used, the mounting place of the spring member 4 can be selected. In the case where the whole spring member 4 is to be positioned firmly as shown in FIGS. 36 and 38, the spring member 37 may be formed in a cross-like configuration or a radially extended configuration at pitches of 120 degrees as indicated by 38. Those modifications can, of course, be applied to other types of ruler devices such as French curves. It is also accepted that the spring member is formed in a circular dome-like configuration so that the slip-preventive member projects along this configuration.

Figure 39:
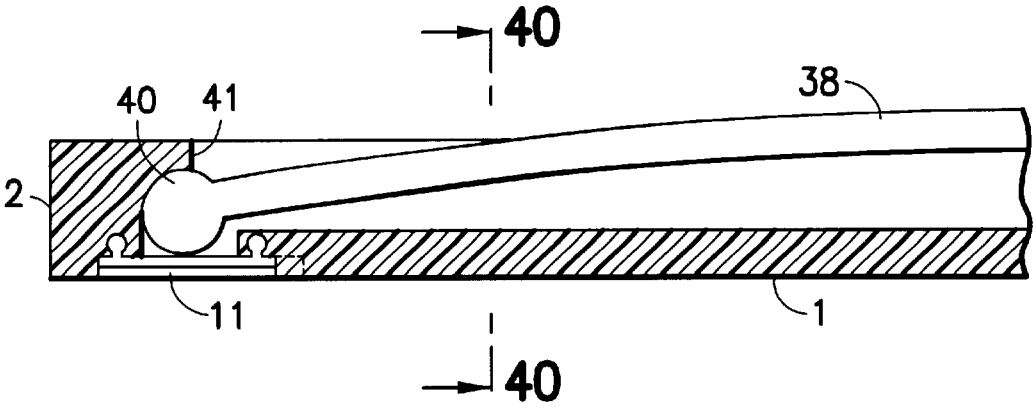
FIG. 39 is a schematic side view showing a further embodiment of a ruler device according to the present invention, in which a rod member is used as a spring member.
Figure 40:
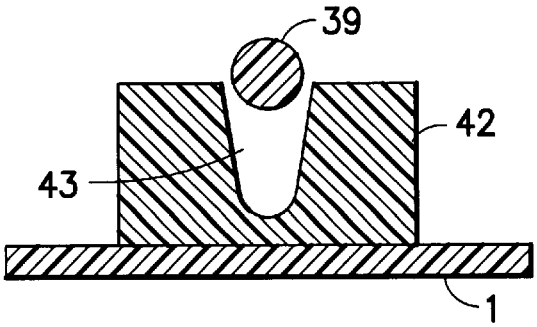
FIG. 40 is a sectional end view taken on line A—A of FIG. 39.

In an example of FIGS. 39 and 40, a rod-like spring member 39 is employed as the spring member. In this example, a ball-like engagement member 40 is disposed on each end portion of the rod-like spring member 39. This ball-like engagement member 40 is engageable with a spherical recess 41 formed in an inner surface of each support portion 2. Thus, a sort of ball joint structure is provided. The rod-like spring member 39 is depressed and returned to its initial state guided by a valley portion 43 which is formed longitudinally in a receiving member 42 formed in the surface of the ruler body 1.

Figure 41:
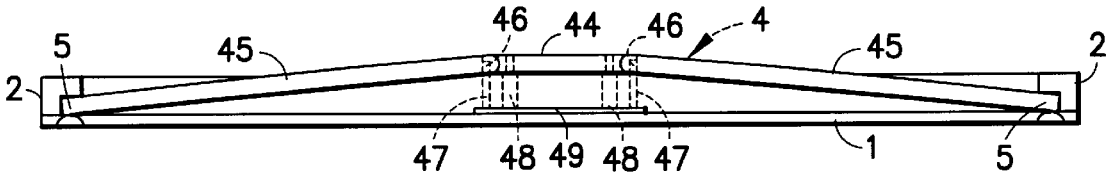
FIG. 41 is a side view showing another example of a mechanism of a ruler device according to the present invention.
Figure 42:
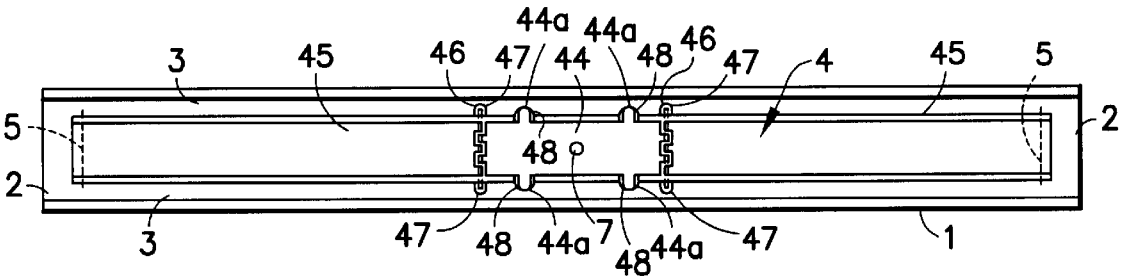
FIG. 42 is a plan view of the above.
Figure 43:
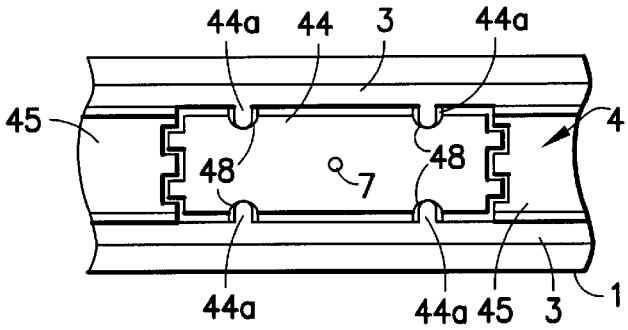
FIG. 43 is a plan view of an essential portion of a modified example of the above.

FIGS. 41 to 43 show further modifications. The plate-like spring member 4 is comprised of a short plate 44 disposed at a central area thereof and long plates 45 disposed on opposite sides of the short plate 44. The short plate 44 and the long plates 45 are interdigitated or connected through pins 46.

Distal ends of the long plates 46 are rounded and point connected to a control portion of the slip-preventive member so as to be moved upwardly and downwardly. In order to move the short plates 44 upwardly and downwardly with precision, grooves 47 for guiding the end portions of the pins 46 are formed in the inner surfaces of the reinforcement ridges 3.

Instead of or in addition to the grooves 47, it is also accepted that projection pieces 44*a* are formed on opposite sides of the short plates 44 and grooves 48 for guiding the projection pieces 44a are formed in the inner surfaces of the reinforcement ridges 3. It is an interesting alternative that the projection pieces 44a are formed on the inner surfaces of the reinforcement ridges 3 and guiding grooves 48 are formed in opposite sides of the short plate 44.

Reference numeral 49 of FIG. 41 denotes a stopper for preventing the short plate 44, which has been depressed from returning to its initial state beyond a dead point. In this example, the stopper 49 is formed in a thin plate-like stepped configuration. In the alternative, it may be in the form of a projection.

A ruler device according to the present invention is constructed and operated in the manner as described hereinbefore. Accordingly, it can, when in use, reliably be positioned and moved smoothly from one place to another when required. In addition, owing to the provision of the cutter guide, the cutter can be used easily without damaging the ruler body.

Obviously, numerous modifications and variations of the present invention are possible in light of the above teachings. It is therefore to be understood that within the scope of the appended claims, the invention may be practiced otherwise than as specifically described herein.

What is claimed is:

1. A ruler device comprising:

a ruler body;

a spring member disposed on an upper surface of said ruler body such that said spring member is warped upwardly; and a slip-preventive member disposed on a lower surface of said ruler body;

wherein said slip preventive member comprises a balloon which is inflated and projected downwardly when said spring member is depressed.

2. A ruler device according to claim 1, wherein said spring member comprises a plate.

3. A ruler device according to claim 1, wherein said spring member comprises a rod.

4. A ruler device according to claim 1, wherein at least one additional spring member is disposed on the upper surface of said ruler.

5. A ruler device according to claim 1, further comprising a cutter guide removably attached to at least one side of said ruler body.

6. A ruler device according to claim 1, wherein said spring member is branched.

7. A ruler device comprising:

a ruler body;

a spring member disposed on an upper surface of said ruler body such that said spring member is warped upwardly; and a slip-preventive member disposed on a lower surface of said ruler body;

wherein said slip-preventive member is caused to project downwardly when said spring member is depressed; and wherein said spring member is connected to a wire.

8. A ruler device comprising:

a ruler body;

a spring member disposed on an upper surface of said ruler body such that said spring member is warped upwardly; and a slip-preventive member disposed on a lower surface of said ruler body;

wherein said slip-preventive member is caused to project downwardly when said spring member is depressed; and wherein said spring member is connected to a link and a cam mechanism.

9. A ruler device according to claim 7, wherein a support portion is provided on the upper surface of said ruler body for supporting an end portion of said spring member.

10. A ruler device according to claim 9, wherein a reinforcement ridge is integrally formed with said support portion in a framelike pattern such that said spring member can go in and out.

11. A ruler device according to claim 1, wherein said spring member is provided with a mark at a central area thereof at which said spring member is preferably depressed.

12. A ruler device according to claims 1, wherein said spring member comprises a plurality of plates continuously connected together.

13. A ruler device according to claim 12, further comprising a stopper for preventing said spring member from moving beyond a dead point.

14. A ruler device according to claim 1, wherein said spring member comprises a plurality of rods continuously connected together.

15. A ruler device according to claim 14, further comprising a stopper for preventing said spring member from moving beyond a dead point.

16. A ruler device according to claim 7, wherein said slip preventive member comprises a replaceable rubber piece.

17. A ruler device according to claim 8, wherein said slip preventive member comprises a replaceable rubber piece.

18. A ruler device according to claim 7, wherein said slip preventive member comprises a balloon which is inflated when said spring member is depressed.

19. A ruler device according to claim 8, wherein said slip preventive member comprises a balloon which is inflated when said spring member is depressed.

20. A ruler device according to claim 7, wherein at least one additional spring member is disposed on the upper surface of said ruler.

21. A ruler device according to claim 8, wherein at least one additional spring member is disposed on the upper surface of said ruler.

22. A ruler device according to claim 7, further comprising a cutter guide removably attached to at least one side of said ruler body.

23. A ruler device according to claim 8, further comprising a cutter guide removably attached to at least one side of said ruler body.

* * * * *